United States Patent [19]

Ellingson, Jr.

[11] Patent Number: 4,903,449

[45] Date of Patent: Feb. 27, 1990

[54] WALL CORNER GUARD STRUCTURE

[76] Inventor: Chester W. Ellingson, Jr., 13909 Frontier La., Burnsville, Minn. 55337

[21] Appl. No.: 351,788

[22] Filed: May 15, 1989

[51] Int. Cl.[4] ..... E04F 13/06

[52] U.S. Cl. ..... 52/288; 52/717

[58] Field of Search ..... 52/288, 716, 718, 717, 52/287

[56] References Cited

U.S. PATENT DOCUMENTS

| | | | |
|---|---|---|---|
| 3,099,058 | 7/1963 | Pettingell | 52/717 X |
| 3,568,386 | 3/1971 | Gossen | 52/288 |
| 3,742,668 | 7/1973 | Oliver | 52/288 |
| 4,204,376 | 5/1980 | Calvert | 52/717 X |
| 4,308,704 | 1/1982 | Lloyd | 52/716 |
| 4,401,701 | 8/1983 | Wolters | 52/716 X |

*Primary Examiner*—Carl D. Friedman
*Assistant Examiner*—Jerrold D. Johnson
*Attorney, Agent, or Firm*—Leo Gregory

[57] ABSTRACT

A unitary wall corner protective member consisting of an underlying layer conforming to the wall member and an overlying layer spaced from said underlying layer, said layers having a common end portion having intermediate thereof a hinge unitary therewith and said layers having releasable interengaging other end portions, said overlying layer being yieldingly resistant to impact and an impact absorbing member intermediate said layers carried by said underlying layer.

1 Claim, 1 Drawing Sheet

WALL CORNER GUARD STRUCTURE

BACKGROUND OF THE INVENTION

1. Field of the Invention

This invention relates to protective structures for wall corners.

2. Brief Description of The Prior Art

Durable sheet material in convenient size has been used for wall corner coverings particularly in hallways having considerable wheeled traffic to protect the corners from damage resulting from abrasion. Metal, rubber and plastic materials have been used for this purpose.

Protective coverings have been developed to have plate members such as of metal secured to the corner and having an overlying member spaced somewhat therefrom and secured thereto providing a somewhat yielding or resilient protective structure.

It is desirable to provide a significant improvement in having a unitary member readily mounted which effectively protects the corner and has a lasting attractive appearance.

SUMMARY OF THE INVENTION

This invention relates to an improvement in the structure of a corner guard.

It is an object to provide a unitary extruded member of an attractive appearing and suitably resilient and durable plastic material.

It is another object herein to provide a unitary wall corner protective structure having an underlying layer conforming to a wall corner and having an overlying layer spaced therefrom and buffering the same.

It is a further object herein to provide a wall corner guard structure formed as a unitary structure having an underlying layer overlying and conforming to a corner structure and being secured thereto and having integral therewith an overlying layer hinged thereto at one end thereof and interlocking with the same at the other end thereof.

With reference to the previous object, it is also an object herein to provide the underlying layer with a shock absorbing cushion or bumper.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
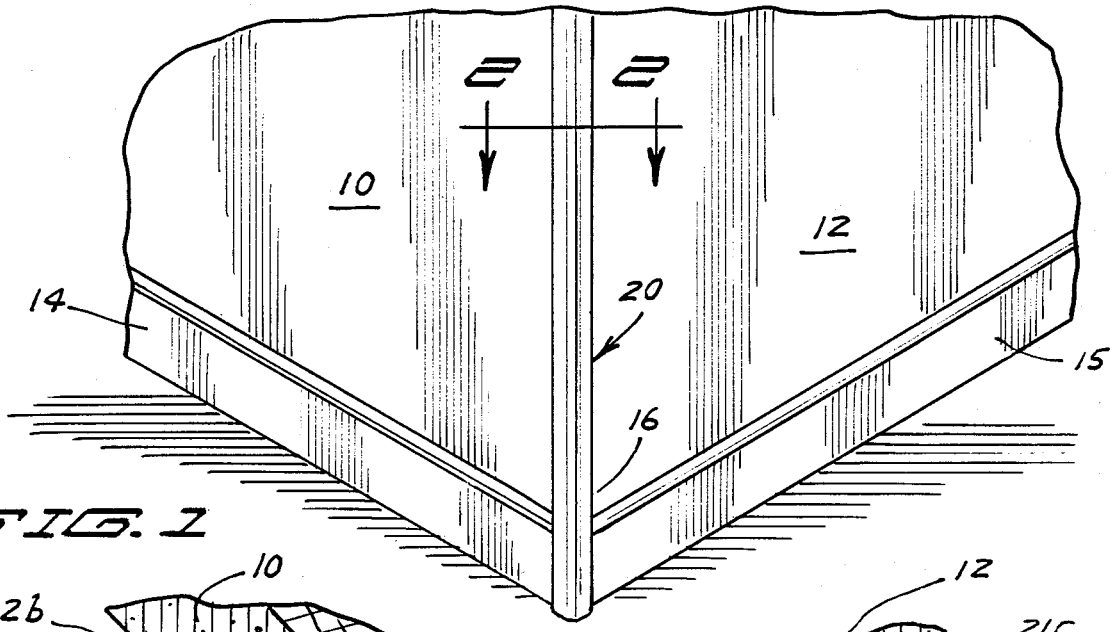
FIG. 1 is a broken view in elevation showing the invention herein in operating position.
Figure 2:
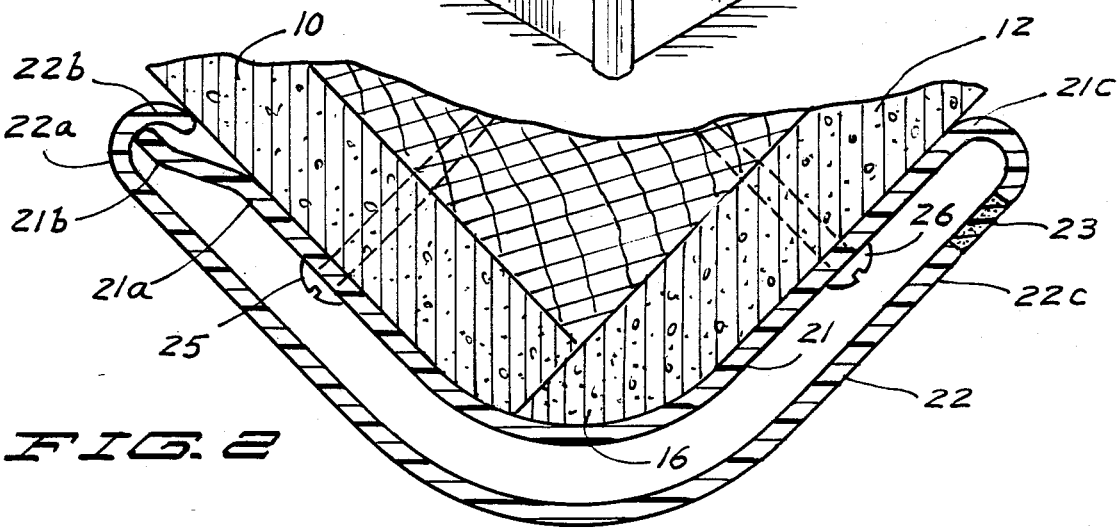
FIG. 2 is a broken view in horizontal section taken on line 2—2 of FIG. 2 showing the same in locked operating position.

Referring to the FIGS., conventional walls, 10 and 12 are shown trimmed with baseboard molding strips 14 and 15. Said walls converge to form a corner 16. The walls define hallways or corridor passages not here shown. Said hallways as here referred to are subject to such traffic as of carts, mobile tables, wheel chairs and the like. Thus the corner 16 is subject to engagement by various of such vehicles traversing the hallways and impacting the corner with various degrees of force whereby the corner in time will show damage and require repair.

Applied to said corner to protect the same from damage for whatever height desired is the corner guard stripping or protective strip 20.

Preferably said strip is formed integrally by extrusion using a high impact plastic material haivng sufficient resilience to withstand the impact of wheeled objects without showing abrasive damage.

The process of extrusion is a well known art and is applied herein to produce the following described configuration of said corner protective strip.

Said strip 20 is unitarily molded in a known manner comprising an underlying layer 21 configured to fit snugly against the corner 16 and is shown secured by screws 25 and 26. Said screws will be vertically spaced as desired for the height of said strip.

The end **21*a* of said underlying layer is an open end and is shown angled upwardly at its tip portion 21*b*. The other end 21*c*** is the closed end and is curved as shown.

An overlying layer 22 is spaced outwardly of said layer 21 and has its closed end **22*c* formed as a continuation of said end 21*c* and intermediate said ends and connecting said ends is a living hinge 23**. Said hinge is formed in the extrusion process and is made of an appropriate durometer of plastic material.

The open end **22*a* of said overlying layer is curved to form a hook-like closure 22*b* which has sufficient resilience to snap over and around the end portion 21*b* to releasingly engage the same. For all practical purposes while in a closed operating position, the end closure 22*b* and the tip portion 21*b*** are in locked engagement. However the overlying layer is readily released from said underlying layer as may be required, such as for installation or replacement. Ready access is had to the underlying layer. However it is seen that once installed, the guard strip may be left undisturbed for long periods of service.

The outer layer will flex upon being bumped as by a vehicle of some kind and has sufficient resilience and toughness to absorb the force of impact without showing the effect thereof. The force of the impact is generally neutralized before the outer layer is caused to engage the underlying layer 21 and the corner 16 therewith.

Figure 3:
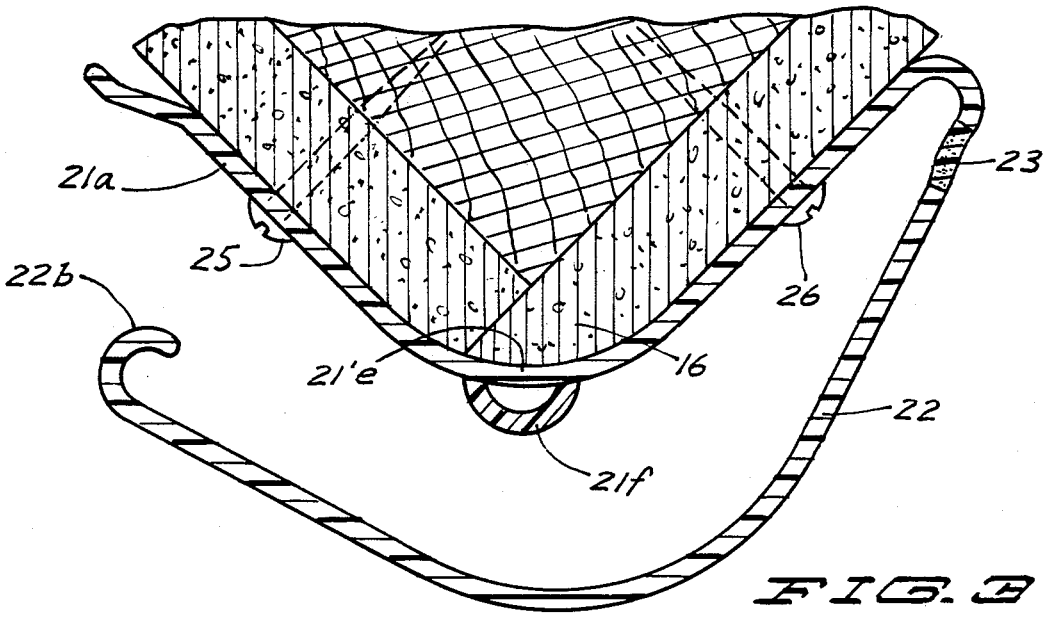
FIG. 3 is a view similar to that of FIG. 2 showing the invention in an unlocked position and showing a modification.

FIG. 3 shows a modification wherein like parts bear the same reference numerals and the modified parts have a prime added.

The underlying layer 21 has integrally secured thereto at the central portion **21*e* thereof a resilient buffer cushion strip 21*f* which as here shown is substantially semi-circular in cross section but may take on other specific forms. Said buffer strip is a very advantageous addition for absorbing impact in corridors where heavy vehicles having considerable impact force are wheeled and there is the probability that otherwise the outer layer would be caused to impact directly upon the underlayer and perhaps in time result in damage to the corner 16**.

The end **22*a* underlies the tip portion 21*b* sufficiently that it will not become disengaged from the underlying tip portion 21*b* upon an inward flexing of the overlying layer 22**.

It will of course be understood that various changes may be made in form, details, arrangement and proportions of the product without departing from the scope of the invention which, generally stated, consists in a product capable of carrying out the objects above set forth, in the part and combination of parts disclosed and defined in the appended claims.

What is claimed is:

1. A guard structure of a corner formed by the convergence of a pair of walls, comprising an underlying layer conforming to and overlying a wall corner surface portion, means securing said underlying layer to said wall surface portion, an overlying layer spaced outwardly from said underlying layer, said overlying layer forming a continuation of said underlying layer at one of said underlying layer's ends with a corresponding of said overlying layers end portion, a living hinge formed intermediate said continuation of said ends of said layers, said underlying layer having its other end tip portion curved outwardly obliquely from said wall corner surface, and said overlying layer having its other end portion reversely curved and adapted to interengage said outwardly curved tip portion end of said underlying layer.

* * * * *